United States Patent [19]

Bennett et al.

[11] Patent Number: 4,495,001

[45] Date of Patent: Jan. 22, 1985

[54] PRODUCTION OF AGE HARDENABLE ALUMINUM EXTRUDED SECTIONS

[75] Inventors: Walter Bennett; John H. Ablewhite; Anthony J. Bryant, all of Banbury, England

[73] Assignee: Alcan International Limited, Montreal, Canada

[21] Appl. No.: 446,697

[22] Filed: Dec. 3, 1982

[30] Foreign Application Priority Data

Dec. 11, 1981 [GB] United Kingdom ..... 8137503

[51] Int. Cl.[3] ..... C22F 1/04

[52] U.S. Cl. ..... 148/11.5 A; 148/12.7 A; 148/159

[58] Field of Search ..... 148/11.5 A, 159, 155, 148/12.7 A, 418, 417; 204/297 R, 297 W; 72/255

[56] References Cited

U.S. PATENT DOCUMENTS

| | | | |
|---|---|---|---|
| 1,920,090 | 7/1933 | Lyon et al. | 148/159 |
| 3,018,885 | 1/1962 | Trautman | 72/255 |
| 3,198,676 | 8/1965 | Sprowls et al. | 148/418 |
| 3,668,910 | 6/1972 | Gentry et al. | 72/255 |
| 4,030,947 | 6/1977 | Kemper | 148/159 |
| 4,212,451 | 7/1980 | Klotzbucher et al. | 148/155 |

FOREIGN PATENT DOCUMENTS

| | | | |
|---|---|---|---|
| 50-39412 | 12/1975 | Japan | 204/297 W |
| 724600 | 4/1980 | U.S.S.R. | 148/12.7 A |

*Primary Examiner*—M. J. Andrews
*Assistant Examiner*—Robert L. McDowell
*Attorney, Agent, or Firm*—Cooper, Dunham, Clark, Griffin & Moran

[57] ABSTRACT

In the thermal ageing of extruded sections of age-hardenable aluminum alloys the sections are progressed through a system having an initial low temperature zone and a subsequent high temperature zone. In order to secure uniform ageing the sections are progressed in a direction transverse to their length and conveniently are arranged in a single layer and spaced apart to ensure acceptably uniform rate of heating to ageing temperature.

6 Claims, 3 Drawing Figures

PRODUCTION OF AGE HARDENABLE ALUMINUM EXTRUDED SECTIONS

The present invention relates to the production of extruded aluminium sections and in particular relates to the production of extruded sections of age hardenable aluminium alloys.

Large tonnages of age hardenable aluminium alloy extruded sections are produced, particularly in aluminium magnesium silicide alloys. After extrusion the sections are cooled to room temperature, straightened by stretching and then cut to length before being subjected to age hardening for development of the required mechanical properties.

In current practice the cut lengths are loaded into a skip or other form of carrier, which is forwarded to the heat treatment furnace in which the load is held at a temperature of 150°–200° C. for periods up to 24 hours. Owing to improvements in extrusion techniques and in apparatus for supplying heated ingots to the extrusion press the age-hardening step has become a constraint on the output of many extrusion press installations.

It is an object of the present invention to provide an improved method and apparatus for performing the age hardening step on extruded sections of the type in question.

It has long been recognised that the age hardening of aluminium magnesium silicide alloys can be carried out more quickly than in conventional procedures by adopting a two stage age hardening process, in which the alloy is initially heated to a conventional age hardening temperature and held at such temperature for a limited time as compared to conventional practice before being heated to a high temperature at which it is held for periods of the order of 10–30 minutes.

A two-stage ageing treatment of aluminium magnesium silicide alloys was described in "Philosophical Magazine" July 1967 pp 51–76.

Although the possibility of performing the age hardening of aluminium magnesium silicide alloys much more rapidly by means of a two stage age hardening technique has thus been available for many years, it is believed that this has never been put into practical operation for the large volume output of a conventional extrusion press.

It will be appreciated that a two-stage ageing process is difficult to apply to the output of a conventional extrusion press when it is realised that there is considerable criticality in the time period at which the alloy is held at each of the two temperatures to which it is subjected during the course of the ageing treatment. Where a large batch of extrusions is loaded into a furnace in a skip in a conventional manner, the time period required to heat the extrusions at the centre of the load to treatment temperature considerably exceeds that required for the extrusions at the outer surface.

We have now realised that the ageing of extrusions of aluminium magnesium silicide alloy and other aluminium alloy which are susceptible of being aged more rapidly by a two-stage process may be performed much more rapidly than in conventional procedures by progressing the sections through a first low temperature zone and a succeeding high temperature zone with the sections arranged transversely to their direction of travel so that in each zone the whole of the section is subjected to substantially identical heat treatment conditions. This would not occur if the sections were progressed through such heat treatment zones arranged substantially longitudinally in relation to their direction of travel.

Although the sections may be introduced into the heating zones in batches on skips, in which the transversely arranged sections are specially spaced apart to allow the passage of the gaseous heat transfer medium between the sections and thus promote a more even heating rate, it is greatly preferred to pass the sections individually through the heating zones since that permits the sections to be raised to temperature more rapidly and permits substantially constant thermal conditions to be maintained, with great economy in heat requirements.

In carrying out the preferred procedure of the present invention it is preferred to cut the extruded sections to length before feeding to the heat treatment furnace. This permits the furnace to be of much smaller transverse dimension (but of greater length) than would be required if the individual extrusions were fed direct from the run off table of the extrusion press.

In performing the process of the present invention the extrusions ae preferably fed through the ageing furnace as a single shallow layer or carpet of individual extruded sections, although it is possible to conceive of two or more layers being progressed through the furnace simultaneously. However the latter possibility would involve considerably greater mechanical complications and would probably increase the overall cost of the furnace.

One lay out for the system is illustrated diagrammatically in FIG. 1.

Figure 1:
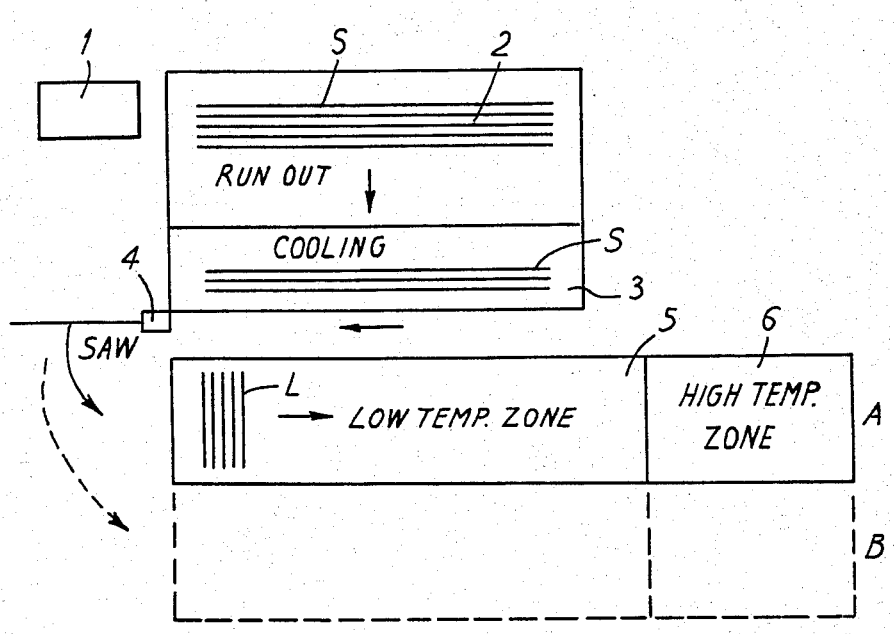

In FIG. 1 sections of aluminium alloy are extruded by an extrusion press 1 onto the run out table 2 and are typically of a length of 55 meters. The sections S are transferred laterally to a conventional cooling and stretching section 3 from which they are progressed individually by any convenient mechanism to a saw 4 and cut off into individual lengths L which are typically of a length of 4–6 meters. In many instances the sections S may be progressed manually to the saw 4 from the stretching stage 3. The ageing furnace, comprised of low temperature zone 5 and high temperature zone 6 is conveniently arranged parallel with the run out table 2 and this involves slewing the cut lengths L through a right angle during transfer from the saw station to the input end of the ageing furnace so that the individual sections pass through the furnace in the necessary transverse position. In order to reduce the overall length of the ageing treatment furnace it may be desired to duplicate the furnace by placing a second furnace side by side with the first furnace as indicated in dotted lines or by placing a second furnace over the top of the first furnace. For ease in mechanical handling of the individual sections the first of these two alternatives is preferred.

When employing the continuous two stage ageing treatment of the present invention it is preferred to chill the extruded section as it leaves the extrusion die of the press 1 since this leads to a reduction in the amount of straightening required and thus reduces delays that may occur at the stretching station. Such chilling may be performed by air blast or by means of water at the die or on the table 2 in appropriate circumstances.

Figure 2:
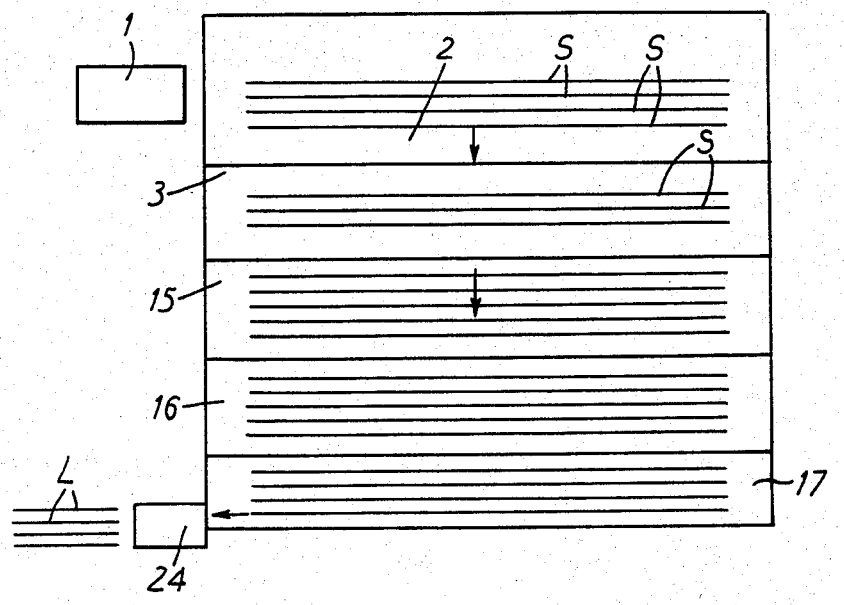
FIG. 2 illustrates an alternative lay out for the system.

The alternative system lay out shown in FIG. 2 is similar to the system shown in FIG. 1.

In FIG. 2 the extruded sections S are extruded by the press 1 onto the run out table 2 and transferred to the cooling and stretching stage 3 as in FIG. 1.

In the system of FIG. 2 the sections are passed from the cooling/stretching stage 3 to a low temperature zone 15 of the ageing furnace and then to the high temperature zone 16 without any intermediate change in direction of travel and without intermediate sawing.

The heating furnace, comprising zones 15 and 16 is much wider than the furnace in the system of FIG. 1 because the transversely travelling sections S are much longer than the cut lengths L of FIG. 1. On the other hand the furnace in this instance is shorter in the direction of travel of the sections. For the heat treatment of a system having a throughput of 10,000 tonnes per year the length (in the direction of travel) of the low temperature zone 15 would be of the order of 30 meters and the length of the high temperature zone 16 would be of the order of 15 meters.

On leaving the high temperature zone 16, the sections S are received on a discharge table 17, cooled and transferred to a saw station 24 for cutting to a convenient size.

Figure 3:
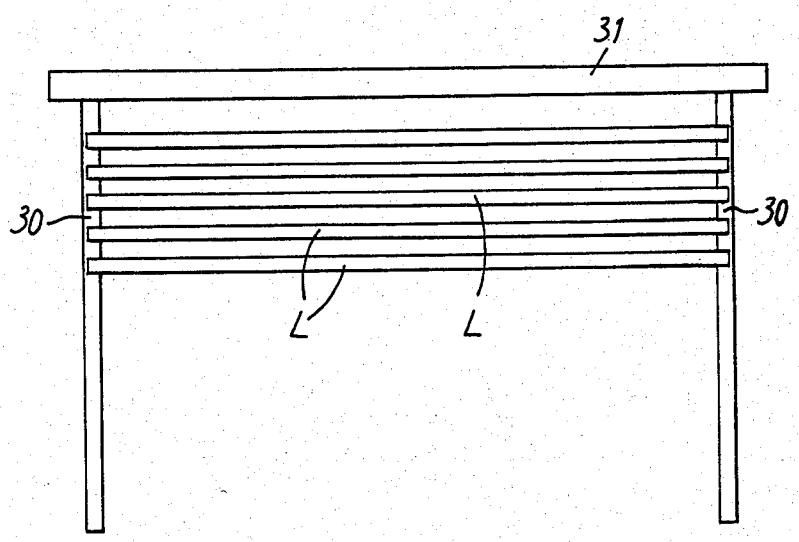
FIG. 3 shows cut lengths of extruded sections formed into a rack of work for anodising.

Most extruded aluminium alloy sections of the class in question are subjected to an anodising operation after the heat treatment stage. In the anodising stage the lengths of extruded section are electrically connected by clamping or spot welding to spline bars 30 are shown in FIG. 3, in which the sections S are spaced from one another and the splines 30 are secured to a flight bar 31 which is connected to one pole of the electrical supply.

In the system of FIG. 1 the sawn lengths L may be formed into a rack of work, ready for anodising, before entry into the ageing furnace section 5. Such racks of work may be progressed to the furnace in a horizontal condition or may be progressed to the furnace suspended from a carrier. This allows the length of the furnace to be greatly reduced as compared with the system of FIG. 1, but requires a corresponding increase in the cross section of the passage through the furnace.

The method of ageing sections individually not only greatly speeds up the ageing treatment but also results in a significant reduction in the heat energy required for the performance of the ageing treatment. This reduction is due not only to the reduction in treatment time but also to the fact that when a single layer of extruded sections is being treated the cross section of the passage through the ageing furnace may be greatly reduced as compared with a conventional ageing furnace in which the sections are carried through on relatively tall skips and there is consequently a substantial improvement in the heat transfer to the work to be treated. Additionally it is unnecessary to heat up the skip or other carrier employed for supporting the load of extrusions in a batch type operation.

Quite apart from the economic advantages to be obtained as a result of the reduction of process time and of the heat requirements involved in performing the two step ageing process on a continuous scale, the correct performance of a two step ageing treatment can also lead to substantial improvements in the mechanical properties of the treated work.

The two step ageing process, carried out continuously, typically involves holding the individual extrusion at a temperature of 160°–200° C. for a time between 45 and 60 minutes in the low temperature heating zone of the furnace and then raising the temperature of the individual extrusions to a temperature of 230°–270° C. in the high temperature zone of the furnace and holding this temperature for a time between 10 and 20 minutes. In order to achieve maximum flexibility of operation the low temperature zone and high temperature zone sections of the furnace are preferably provided with separate conveyors, the travel rate of which may be independently controlled in relation to one another so that the duration of the heat treatment in the high temperature zone is not tied to the duration of the heat treatment in the low temperature zone.

It has been found that the rates of heating to and cooling from the ageing temperatures are not of great significance within normal commercial limits for aluminium magnesium silicide alloys and it has further been found that delays of up to 1½ hours between emergence of the extruded section from the press and commencement of the ageing treatment has substantially no effect.

The relative insensitivity of the mechanical properties of aluminium magnesium silicide extrusions treated by this ageing process makes it particularly suitable for incorporation in large scale commercial production where the extrusions are individually rapidly heated to the required temperatures on entry to the respective furnace zones while moving in a continuous layer of extrusions arranged transversely to the direction of their progress through the ageing furnace.

The two stage ageing process, outlined above, is based on the conception of two temperatures, first of which, a lower temperature ($T_1$) at which stable clusters of precipitated particles can be formed to the maximum possible extent in as short a time as possible but without the necessity of holding the material at this temperature for a time which will promote further development of the clusters with loss of coherency with the matrix. The second, higher, temperature ($T_2$) is at a level sufficient to nucleate the $Mg_2Si$ phase from the Guinier-Preston zone structure developed during ageing at temperature $T_1$, to an optimum dispersion reaching peak mechanical properties in the shortest possible time.

Preliminary tests have been carried out in the laboratory to establish minimum ageing times and temperatures using test specimens cut from flat bars extruded under normal commercial practices and cooled in air to room temperature. For these laboratory experiments the material was solution-treated at 520° C. for 30 minutes before the various experimental ageing conditions were applied.

Composition of the test materials were varied between the following limits (weight %)

Fe 0.20–0.23
Mg 0.36–0.51
Si 0.45–0.49
Mn 0.06–0.09
Others 0.05 max.
Al remainder.

Specimen thicknesses of 0.8, 3, and 12.5 mm were used. Solution treatment temperatures 520°–560° C. Cooling rates after solution treatment 1.5°–1667° C./sec. Delay times between quenching and commencement of the ageing cycle 0–30 minutes.

None of these variables was found to have any significant effect on the final mechanical properties obtained. Examples of mechanical properties obtained are:

(1) 3 mm thick, 50 mm wide flat bar, 250 mm long, solution treated at 520° C. for 30 minutes, water-quenched, held 60 minutes at 160° C. followed by 20 minutes at 250° C.

| Alloy composition: Fe 0.20 Mg 0.46 Si 0.46 Mn 0.06 (weight %) (others 0.03% Max, Al remainder) | | | |
|---|---|---|---|
| 0.2% proof stress ($N/mm^2$) | U.T.S. ($N/mm^2$) | Elongation (% on 50 mm) | Hardness HV5 |
| 185 | 214 | 13.6 | 72.7 |

(2) 12.5 mm thick angle section, leg length 25 mm. Treatment conditions same as for Example (1).

| Alloy composition: Fe 0.23 Mg 0.51 Si 0.47 Mn 0.06 (weight %) (others 0.03% Max, Al remainder) | | | |
|---|---|---|---|
| 0.2% proof stress ($N/mm^2$) | U.T.S. ($N/mm^2$) | Elongation (% on 50 mm) | Hardness HV5 |
| 207 | 236 | 17.6 | 80.4 |

(3) Architectural section 1.5 mm thick from a commercial extrusion press, cut at the press then transferred after 20 minutes at room temperature to a laboratory ageing furnace where it was heated 45 mins. at 170° C. followed by 20 mins at 250° C.

| Alloy composition: Fe 0.22 Mg 0.49 Si 0.49 Mn 0.05 (weight %) (others 0.03% Max, Al remainder) | | | |
|---|---|---|---|
| 0.2% proof stress ($N/mm^2$) | U.T.S. ($N/mm^2$) | Elongation (% on 50 mm) | Hardness HV5 |
| 166 | 204 | 13.7 | 67.2 |

The procedure of the present invention is applicable to the ageing of any aluminium alloy extrusions where it is found that the ageing of the alloy can be carried out rapidly by performing the ageing step in two steps at different temperatures with appropriate modification of the times and temperatures at which the extruded sections are held in the low temperature zone and high temperature zone respectively. Thus the process of the invention is applicable to the ageing of extruded sections of alloys of the Al-Zn-Mg series as well as to the aluminium magnesium silicide alloys exemplified above.

We claim:

1. In a method of producing extruded sections of an age hardenable alloy, in which extruded sections are extruded onto a run out table and laterally moved therefrom to a cooling and stretching station the improvement which comprises progressing the cooled and stretched sections into, through and out of a relatively low temperature first thermal ageing zone while travelling in a direction transverse to their length and into, through and out of a second, higher ageing temperature zone also while travelling in a direction transverse to their length.

2. A method according to claim 1 in which said extruded sections are progressed individually and successively through said zones in one or more discrete layers.

3. A method according to claim 1 in which the rate of travel through the second zone is controllable with relation to the rate of travel in the first zone in order to control the dwell time in the second zone in relation to the dwell time in the first zone.

4. A method according to claim 1 in which the extrusions are progressed through a relatively low temperature zone held at 160°–200° C. during a period of 45–60 minutes and are progressed through a high temperature zone held at 230°–260° C. during a period of 10–20 minutes.

5. A method according to claim 1 in which said sections are progressed through said zones while secured to spline members arranged substantially perpendicular to said sections, said splines being in a vertical position and said sections being spaced from each other and lying one above the other in the vertical direction.

6. A method according to claim 1 further comprising extruding aluminium magnesium silicide alloy sections onto a table, moving said sections laterally on said table, cooling and stretching said sections, advancing said sections longitudinally to a sawing station and sawing said sections to desired sawn lengths at said sawing station, slewing said sawn lengths through an angle of the order of 90° at the sawing station and then advancing said sawn lengths of extruded section through said low temperature zone and high temperature zone while arranged in a direction transverse to their lengths.

* * * * *